US008740221B2

(12) United States Patent
Bondiskey

(10) Patent No.: US 8,740,221 B2
(45) Date of Patent: Jun. 3, 2014

(54) APPARATUS AND METHOD FOR PLAYING A SKILL GAME

(76) Inventor: Joseph M. Bondiskey, Philadelphia, PA (US)

( * ) Notice: Subject to any disclaimer, the term of this patent is extended or adjusted under 35 U.S.C. 154(b) by 107 days.

(21) Appl. No.: 13/612,051

(22) Filed: Sep. 12, 2012

(65) Prior Publication Data

US 2014/0070491 A1 Mar. 13, 2014

(51) Int. Cl.
*A63F 9/00* (2006.01)

(52) U.S. Cl.
USPC ..... 273/331; 273/119 R; 273/441

(58) Field of Classification Search
USPC ..... 273/108, 118 R, 119 R, 123 R, 129 K, 273/120 R, 331, 333, 441, 459, 472
See application file for complete search history.

(56) References Cited

U.S. PATENT DOCUMENTS

| | | | | |
|---|---|---|---|---|
| 3,204,965 | A * | 9/1965 | Engle | 273/119 R |
| 3,350,097 | A | 10/1967 | Chevrette et al. | |
| 3,599,978 | A | 8/1971 | Sondergaard | |
| 3,656,747 | A | 4/1972 | Revell, Jr. et al. | |
| 3,770,273 | A * | 11/1973 | Reiner | 273/333 |
| 4,863,175 | A | 9/1989 | Ricks, Jr. et al. | |
| 5,632,490 | A * | 5/1997 | Brown | 273/350 |
| 5,836,837 | A | 11/1998 | Craig | |
| 6,142,890 | A | 11/2000 | Craig | |
| 6,971,648 | B2 * | 12/2005 | MacKinnon | 273/119 R |
| 8,011,664 | B2 | 9/2011 | Hilbert, Jr. et al. | |

* cited by examiner

*Primary Examiner* — Nini Legesse
(74) *Attorney, Agent, or Firm* — Wood, Herron & Evans, LLP

(57) ABSTRACT

An apparatus for playing a skill game includes a generally vertically extending tube having a first, lower end; a second, upper end; and an axially extending passage. At least one outlet is located proximate the first end of the tube, and a play ball is supported by a flexible tether for swinging movement in a direction toward a scoring ball supported on the tube. The apparatus further includes a first receptacle for receiving the scoring ball if the scoring ball is appropriately struck by the play ball when a player swings the play ball in a direction toward the scoring ball supported on the tube.

12 Claims, 6 Drawing Sheets

APPARATUS AND METHOD FOR PLAYING A SKILL GAME

TECHNICAL FIELD

The present invention relates generally to games of skill and chance, and more particularly to an apparatus and method for playing a skill game utilizing a tethered ball.

BACKGROUND

Various games have been played by individuals and groups for entertainment, enjoyment, and competition. Many such games are known that involve elements of skill and/or elements of chance, and which may be designed to simulate elements or the play of other games. Games heretofore known have not adequately provided a simulation of elements found in a round of golf. A need therefore exists for a skill game that can be played by individuals or groups, and which simulates elements of a golf game without requiring a large playing area or extensive equipment to play the game.

SUMMARY

The present invention provides a game that can be enjoyed by individuals or teams, and which involves both elements of skill and of chance. In one aspect, the game simulates elements of a golf game, but does not require extensive equipment or a large playing field. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, an apparatus for playing a skill game includes a generally vertically extending tube having a first, lower end; a second, upper end; and an axially extending passage. At least one outlet is located proximate the first, lower end of the tube. A play ball is supported by a flexible tether for swinging movement in a direction toward a scoring ball supported on the tube. The apparatus further includes a first receptacle for receiving the scoring ball if the scoring ball is appropriately struck by the play ball when a player swings the play ball in a direction toward the scoring ball supported on the tube.

In one embodiment, a boom is coupled proximate the second end of the tube. A distal end of the boom extends outwardly from the tube and supports the play ball on the tether such that the tether and play ball are spaced from the tube. In another aspect, the apparatus for playing the skill game may include first and second outlets. The apparatus may further include second and third receptacles positioned proximate the first and second outlets, respectively, for receiving the scoring ball if the play ball fails to strike the scoring ball and knock it into the first receptacle.

In another aspect, a method of playing a skill game includes supporting a scoring ball on a generally vertically extending tube, and directing a play ball supported on a tether in a direction toward the scoring ball in an attempt to strike the scoring ball and knock the scoring ball into a first receptacle. The method may further include determining a score after attempting to strike the scoring ball with the play ball, wherein the score is determined based on whether the play ball missed the scoring ball, or whether the scoring ball was knocked into the first receptacle.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
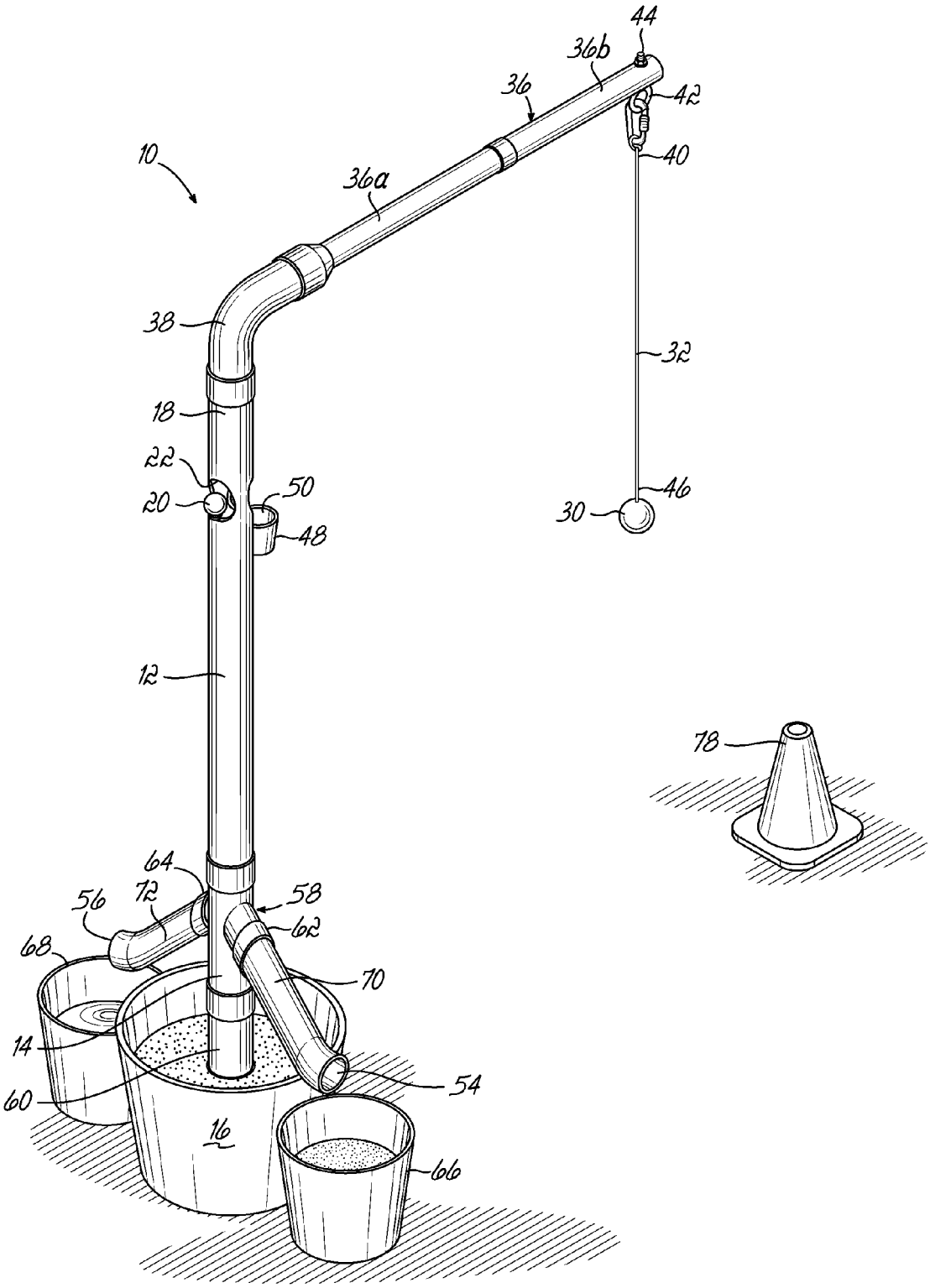
FIG. 1 is a perspective view of an exemplary apparatus for playing a game in accordance with the principles of the present invention.
Figure 2:
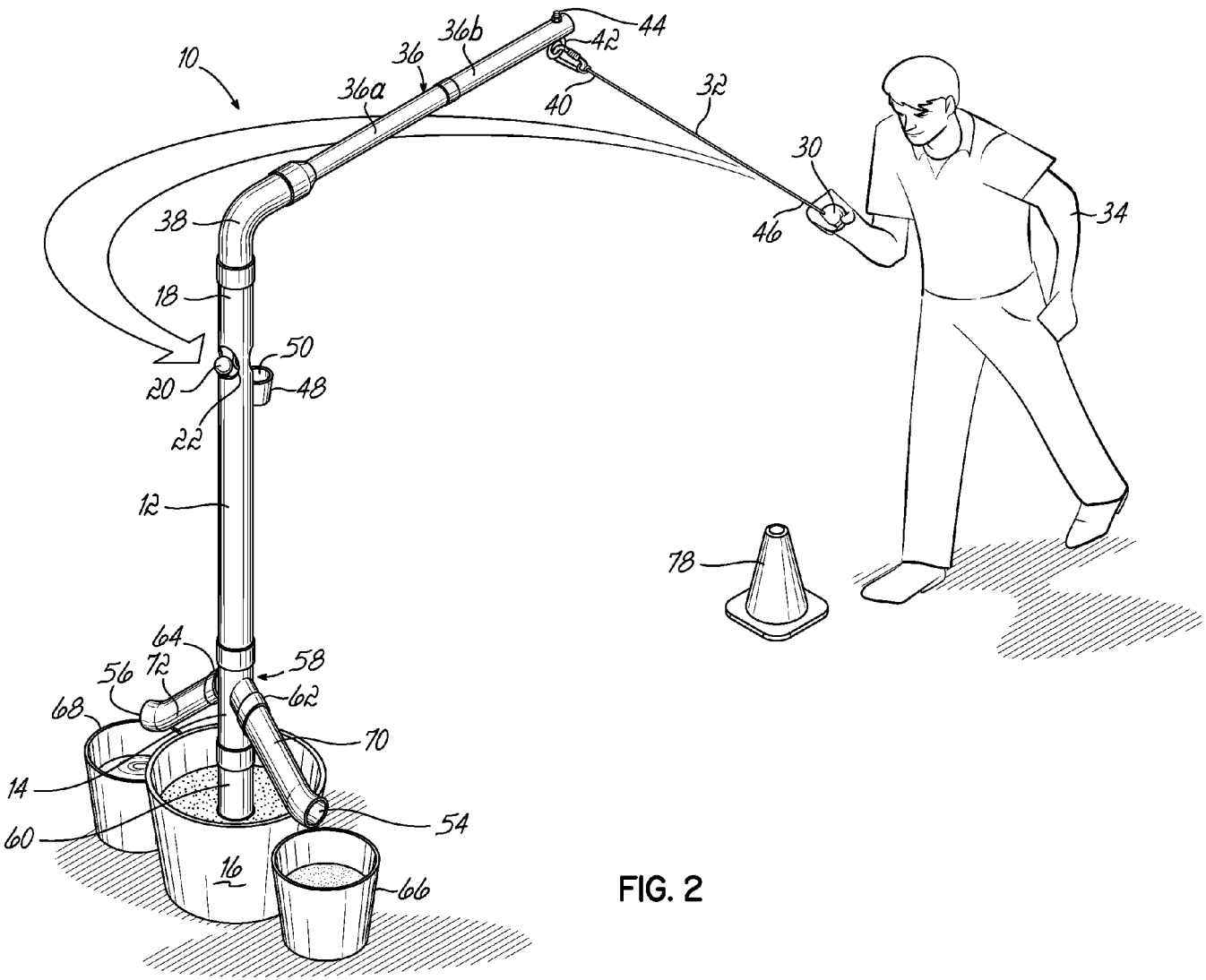
FIG. 2 is a perspective view similar to FIG. 1 and illustrating an aspect of play of the game.

FIGS. 1-2 depict an exemplary apparatus 10 for playing a skill game in accordance with the principles of the present invention. In the embodiment shown, the apparatus 10 includes a generally vertically extending main tube 12 having a first, lower end 14 supported by a base 16 for stably maintaining the tube 12 in the vertical position. The tube 12 further includes a second, upper end 18 and an axially extending passage 26 (see FIGS. 3A-3C) extending between the first and second ends 14, 18. A portion of the tube 12 intermediate the first and second ends 14, 18 is configured and arranged to support a scoring ball 20 thereon during play of the game. In the embodiment shown, the scoring ball 20 is supported in a first aperture 22 formed through a sidewall of the tube 12. The apparatus 10 may include a ball mount 24 (see FIGS. 3A-3C), such as a tee structure, a platform, or any other structure suitable to stably support the scoring ball 20 adjacent the first aperture 22.

The apparatus 10 further includes a play ball 30 supported on a flexible tether 32, such that a player 34 can swing the play ball 30 in a direction toward the scoring ball 22. In the embodiment shown, the tether 32 is coupled to a boom 36 extending from the second, upper end 18 of the main tube 12, in a direction generally radially outwardly from the tube 12. In this embodiment, the boom 36 is coupled to the tube 12 by an elbow fitting 38, such that the boom 36 extends generally upwardly and outwardly from the tube 12. The boom 36 may comprise a single member or, as depicted herein, may comprise several members 36*a*, 36*b* coupled together to facilitate adjusting the position of the tether 32 relative to the tube 12 and/or to facilitate disassembly of the boom 36 for storage and/or transportation of the apparatus 10 when not in use.

In the embodiment shown, the tether 32 is coupled at a first end 40 to a ring or eye-hook 42 secured proximate the distal end of the boom 36 by a fastener 44. The play ball 30 is coupled to the second end 46 of the tether 32, whereby the play ball 30 may be swung in a direction toward the tube 12 and scoring ball 20 as will be described herein below. While the tether 32 supporting the play ball 30 is shown herein coupled to a boom 36 that extends from the second end 18 of the tube 12, it will be appreciated that the tether 32 may alternatively be coupled to other structure to allow swinging movement of the play ball 30 in a direction toward the scoring ball 20. For example, the tether 32 may alternatively be coupled to a separate stand, to a portion of a building such as a ceiling or wall, or to any other structure suitable to support the play ball 30 for swinging movement in a direction toward the scoring ball 20.

Figure 3A:
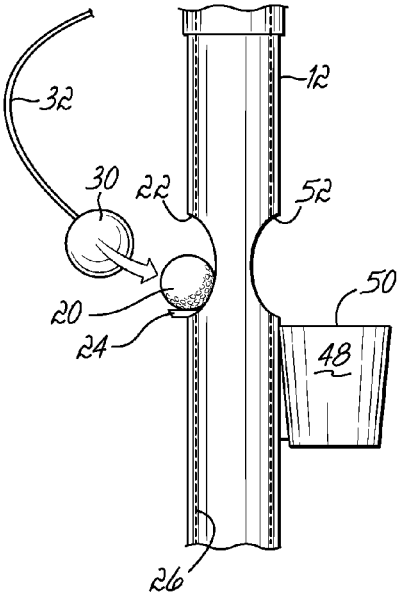
FIG. 3A is a partial side elevation of the apparatus of FIG. 2, depicting an aspect of the game.
Figure 3B:
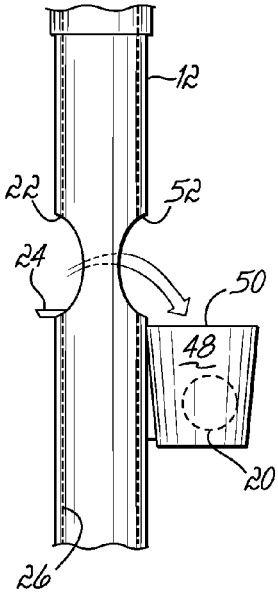
FIG. 3B is a side elevation similar to FIG. 3A and depicting a first scoring aspect of the game during play.
Figure 3C:
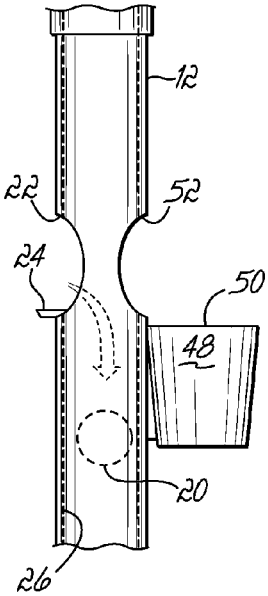
FIG. 3C is a side elevation similar to FIG. 3A and illustrating an aspect of the game during play.

With continued reference to FIGS. 1-2, and referring to FIGS. 3A-3C, the apparatus 10 further includes a first receptacle 48 spaced from the portion of the tube 12 that supports the scoring ball 20 and positioned to receive the scoring ball 20 through an open end 50 thereof when appropriately struck by the play ball 30 during play of the game. In the embodiment shown, the first receptacle 48 is attached to the tube 12 adjacent a second aperture 52 through a sidewall of the tube 12 and diametrically opposite the first aperture 22. In this configuration, a player may view the scoring ball 20 through the first and second apertures 22, 52 during play, as will be described in more detail below.

Figure 4A:
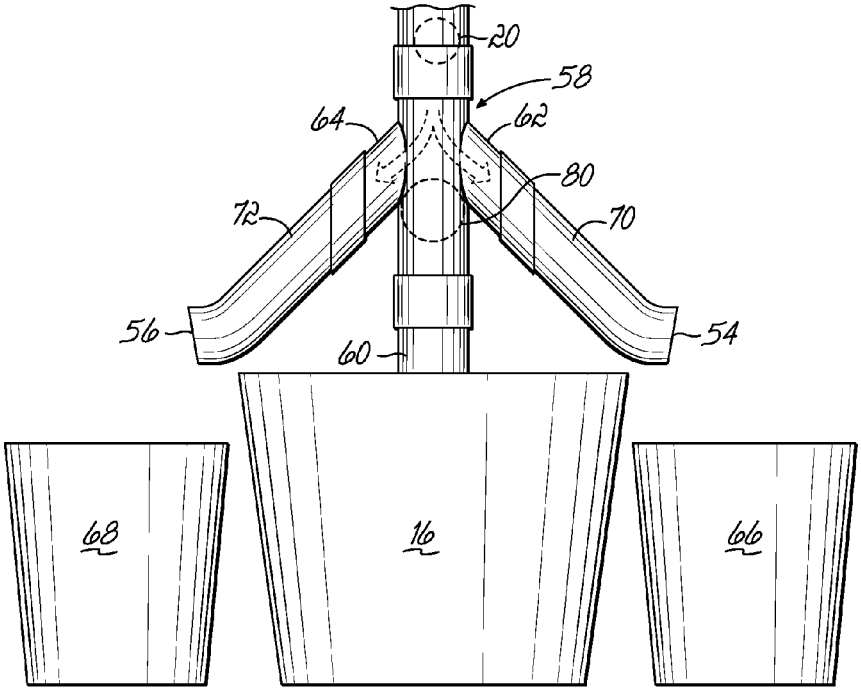
FIG. 4A is a partial side elevation of a lower portion of the apparatus of FIG. 2, depicting additional scoring features in accordance with the principles of the invention.
Figure 4B:
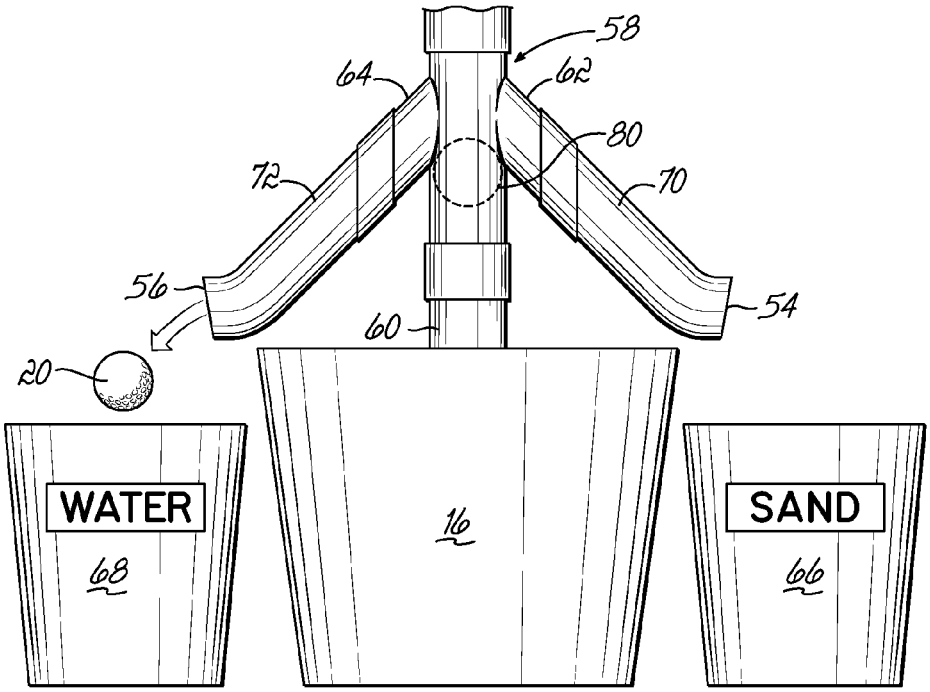
FIG. 4B is a side elevation similar to FIG. 4A, depicting a second scoring aspect of the game during play.
Figure 4C:
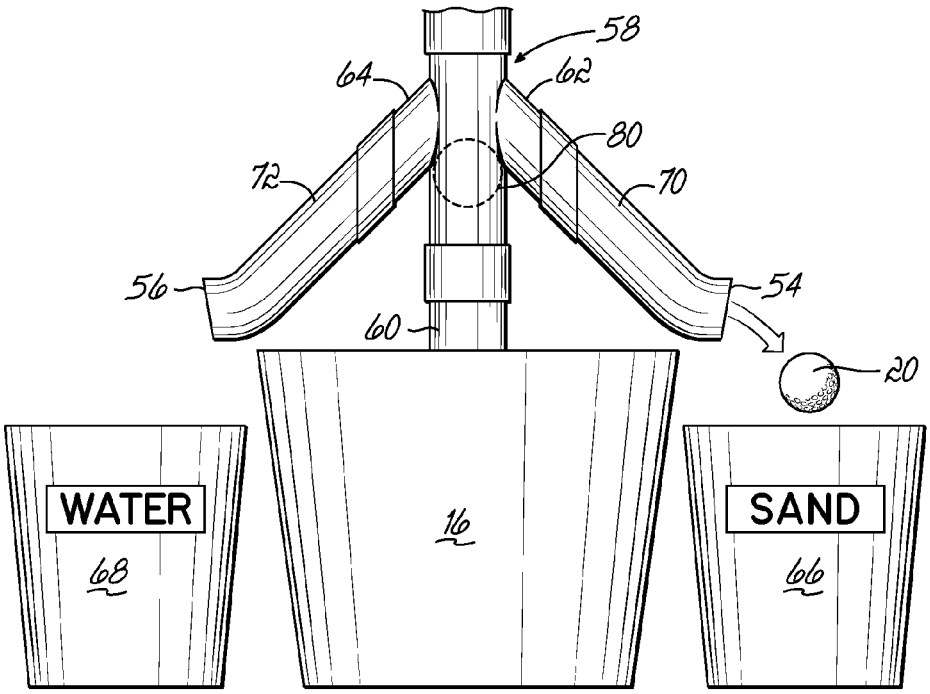
FIG. 4C is a side elevation similar to FIG. 4A, depicting a third scoring aspect of the game during play.

At least one outlet 54, 56 is provided at the first, lower end 14 of the tube 12, through which the scoring ball 20 may exit the tube 12 in accordance with another aspect of the game. In the embodiment shown, two outlets 54, 56 are provided for additional scoring options and to add an element of chance to the game. The first and second outlets 54, 56 are provided by a double-Y (Wye) fitting 58 coupled proximate the first end 14 of the main tube 12, as depicted in FIGS. 4A-4C. A straight portion 60 of the double-Y-fitting 58 is coupled to the base 16, and first and second branches 62, 64 of the double-Y fitting 58 direct the scoring ball 20 toward the first and second outlets 54, 56, respectively. The apparatus 12 further includes second and third receptacles 66, 68 positioned adjacent the first and second outlets 54, 56, respectively, for receiving the scoring ball 20 during play of the game. In the embodiment shown, a first conduit 70 is coupled to the first branch 62 of the double-Y fitting 58 and terminates in the first outlet 54, adjacent the second receptacle 66. Similarly, a second conduit 72 is coupled to the second branch 64 of the double-Y fitting 58 and terminates in the second outlet 56, adjacent the third receptacle 68.

Various components of the apparatus 10 may be assembled from plastic pipe components, such as polyvinylchloride (PVC) pipe, or from any other material suitable to form the apparatus 10. Moreover, components such as the main tube 12 and boom 36 may comprise single members, or may comprise multiple members joined together to form the components. Advantageously, when the components comprise multiple members joined together in an easily separable fashion, the apparatus 10 may be disassembled for convenient storage and/or transportation when not in use.

The exemplary apparatus 10 described above may be used to play one or more games. In one embodiment of a game in accordance with the principles of the present invention, a player 34 grasps the play ball 30 supported by the tether 32 and stands at a predetermined location to begin play, as depicted in FIG. 2. The predetermined location may be indicated, for example, by a cone 78 or any other structure or indicator suitable to identify a position spaced a distance from the base 16 and vertically extending tube 12. The player 34 then swings the play ball 30 in a direction toward the tube 12 and scoring ball 20 in an attempt to strike the scoring ball 20 and thereby knock the scoring ball 20 from its position in the first aperture 22 and into the first receptacle 48, as depicted in FIGS. 3A-3B. A successful attempt in this aspect requires that the play ball 30 strike the scoring ball 20 such that the scoring ball 20 passes from the first aperture 22, across the axial passage 26 of the tube 12, through the second aperture 52, and into the open end 50 of the first receptacle 48. If the play ball 30 does not adequately strike the scoring ball 20, the scoring ball 20 may be knocked from the first aperture 22 and may fall through the axial passage 26 of the tube 12 toward the first end 14, as depicted in FIG. 3C. As the scoring ball 20 falls toward the first end 14 of the tube 12, the scoring ball 20 may be diverted toward either the first outlet 54 or the second outlet 56, as depicted in FIGS. 4A-4C, thereby adding an element of chance to the game.

The apparatus 12 may further include a deflector 80 proximate the first end 14 of the tube 12 to deflect the scoring ball 20 toward one of the first or second outlets 54, 56. In the embodiment shown, the deflector 80 comprises a ball, such as a tennis ball or a racquet ball for example, having an outer diameter sufficiently large enough to allow the ball to be lodged securely within the double-Y fitting 58 at a position that permits the scoring ball 20 to fall into one of the first or second branches 62, 64 of the fitting 58 and thereby deflect the scoring ball 20 toward one of the first or second outlets 54, 56. While the deflector 80 is shown and described herein as a ball, it will be appreciated that the deflector 80 may alternatively comprise various other structure suitable for deflecting the scoring ball 20 toward one of the first or second outlets 54, 56.

In accordance with another aspect of the present invention, the apparatus 12 may be used to play a game that simulates elements of a round of golf. In accordance with this aspect, the game may be played, as described above, by swinging the play ball 30 in a direction toward the scoring ball 20 supported in the first aperture 22, and a score is given to the player 34 based on whether the scoring ball 20 is knocked into the first, second, or third receptacles 48, 66, 68. More specifically, the first receptacle 48 may represent the cup on a golf green and, upon successfully knocking the scoring ball 20 into the first receptacle 48, the player 34 is awarded a score of one stroke. Alternatively, if the scoring ball 20 is instead knocked through the axial passage 26 of the tube 12, the player 34 is given a score of either two strokes or three stokes, depending upon whether the scoring ball 20 exits the first outlet 54 or the second outlet 56. Specifically, the second receptacle 66 adjacent the first outlet 54 may be filled with sand (or otherwise indicated to represent a sand hazard), and the third receptacle 68 adjacent the second outlet 56 may be filled with water (or otherwise indicated to represent a water hazard). If the scoring ball 20 exits the first outlet 54 and is received in the second receptacle 66 (sand hazard), the player 34 is given a score of two strokes. Alternatively, if the scoring ball 20 exits the second outlet 56 and is received in the third receptacle 68 (water hazard), the player 34 is given a score of three strokes. If the player 34 fails to contact the scoring ball 20 after three attempts, the player 34 is given a score of four strokes. The object of the game in this embodiment is to obtain the lowest score possible for all rounds played. It will be appreciated that the game according to this embodiment may be played by one or more players, and multiple players may play individually or in teams. The winner of a round during a multi-player game is the player or team that has the lowest score at the end of the total number of holes played.

The exemplary game described above represents only one of many possible variations of games that may be played using the apparatus 10. It will be appreciated that various other games and variations may alternatively be played using an apparatus 10 in accordance with the principles of the invention.

Figure 5:
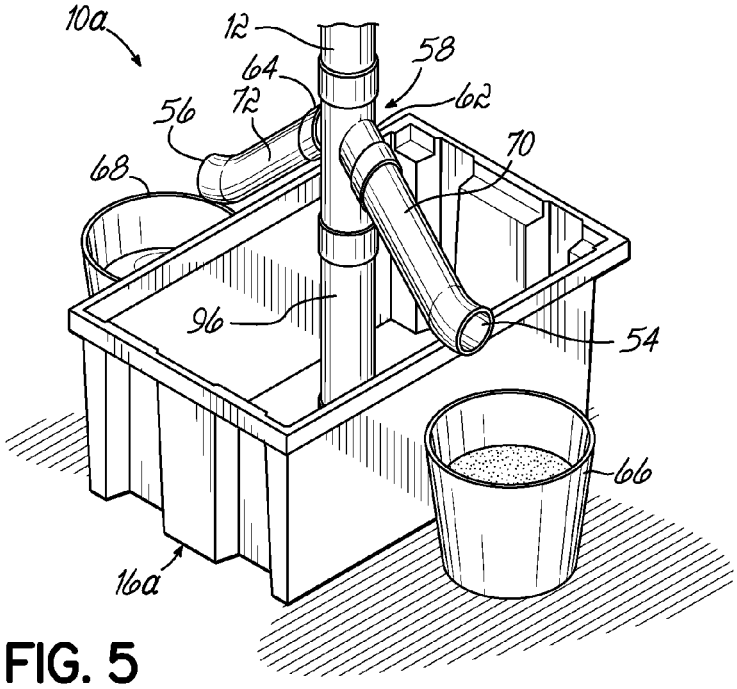
FIG. 5 is a partial perspective view of a lower portion of an alternative embodiment of an apparatus for playing a game in accordance with the principles of the present invention.
Figure 5A:
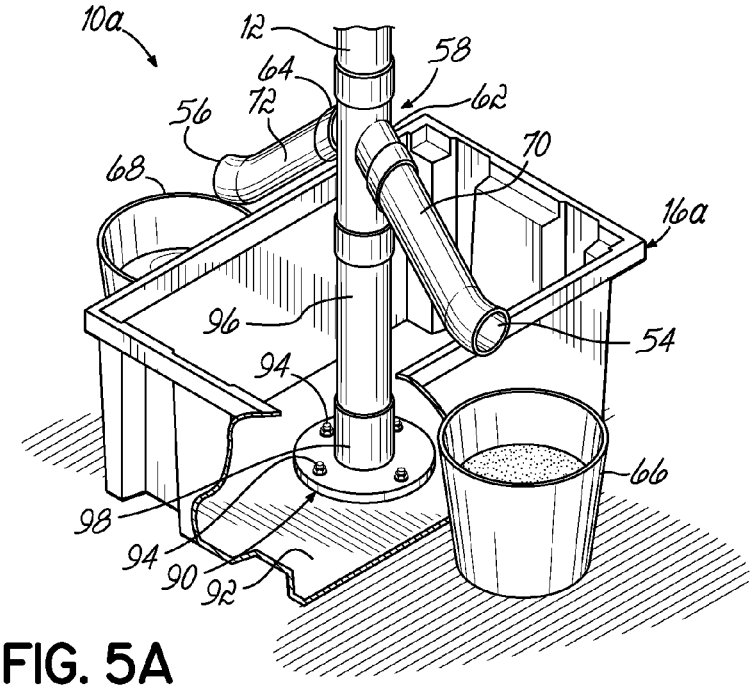
FIG. 5A is a partial perspective view similar to FIG. 5 and illustrating the connection of various components of the apparatus.

FIGS. 5 and 5A depict an alternative apparatus 10*a* wherein features similar to the apparatus 10 depicted in FIGS. 1-4C are numbered with similar reference numerals. In this embodiment, the base 16*a* of the apparatus 10*a* comprises a storage container that facilitates supporting the main tube 12 in a generally vertical orientation during play, and which may be used to store and/or transport components of the apparatus 10*a* during periods of nonuse. In the embodiment shown, a flanged fitting 90 is secured to a bottom wall 92 of the container 16*a,* such as by fasteners 94, and a tube section 96 is supported by a boss portion 98 of the flanged fitting 90 to extend vertically upward from the bottom wall 92 for connection with a double-Y fitting 58 that is similar to the double-Y fitting 58 of the apparatus 10 described above. While the flanged fitting 90 is shown and described herein as being secured to the bottom wall 92 of the container 16*a* by fasteners 94, it will be appreciated that the flanged fitting 90 may alternatively be coupled to the bottom wall 92 by various other methods, such as by glue, heat welding, or any other method suitable for stably securing the tube 12*a* to the bottom wall 92 of the container 16*a*. Various other features of the apparatus 10*a* are similar to those shown and described above with respect to the apparatus 10 depicted in FIGS. 1-4C.

While base 16*a* is shown and described with respect to FIGS. 5 and 5A as one possible type of storage container, it will be appreciated that various other storage containers or other structure suitable to support the vertically extending tube 12 may alternatively be used. As a non-limiting example, the base may alternatively comprise a storage container having a lid or cover that may be hinged or removable from the main body of the storage container. If the storage container does include a lid or cover, the lid or cover may include apertures or other features configured to cooperate with the tube 12 so that the tube 12 extends in the generally vertical direction during use, and which may facilitate stabilizing the tube 12 during use.

Figure 6:
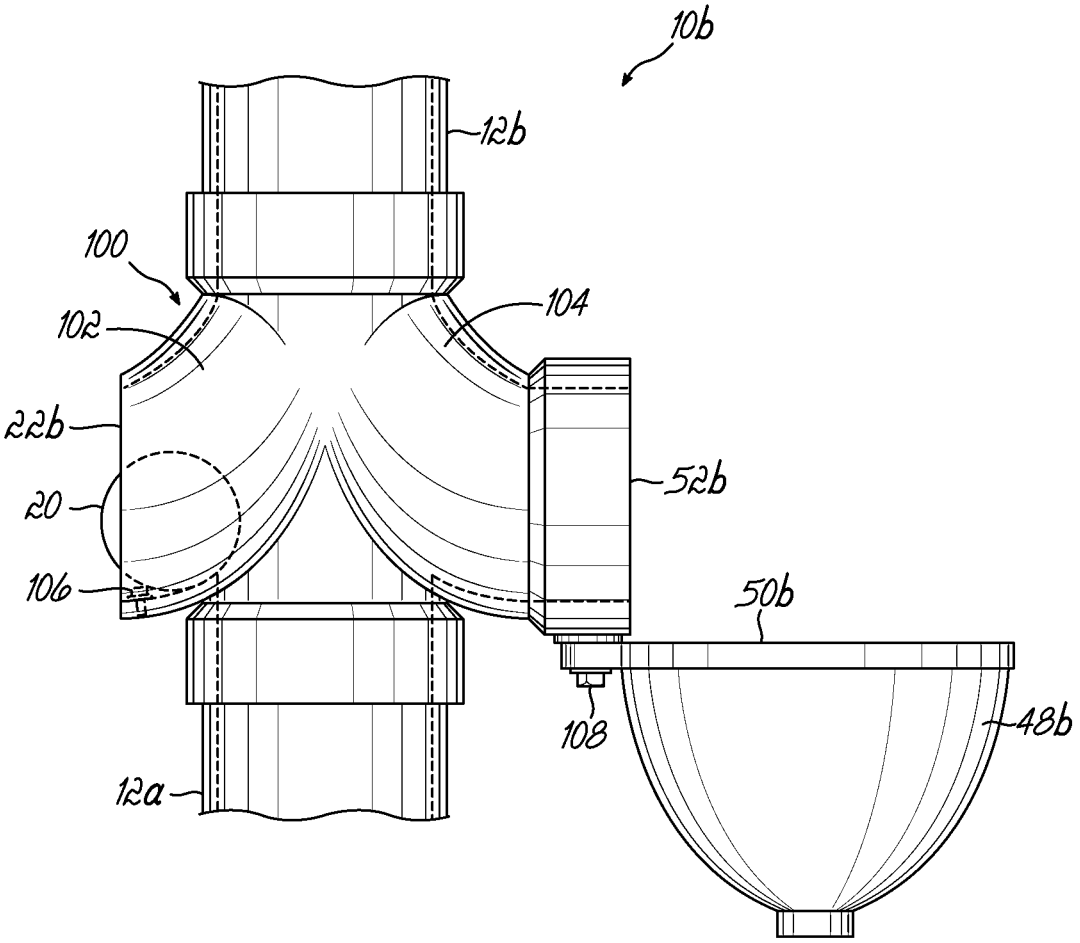
FIG. 6 is a partial side view of another alternative embodiment of an apparatus for playing a game in accordance with the principles of the present invention.

FIG. 6 depicts a portion of another exemplary apparatus 10*b* which is similar to the apparatus 10 shown and described above with respect to FIGS. 1-4C and wherein similar features have been numbered with similar reference numerals. In this embodiment, the portion of the apparatus 10*b* for supporting a scoring ball 20 during play comprises a double-cross fitting 100 coupled intermediate the first and second ends 14, 18 of the main tube 12*b*. A first branch 102 of the double-cross fitting 100 may be shorter in length compared to a second branch 104 of the fitting 100 to facilitate supporting the scoring ball 20 within a first aperture 22*b* defined by the first branch 102, as depicted in FIG. 6. In the embodiment shown, the double-cross fitting 100 is may be a commercially available pipe section that has been modified, such as by cutting or other machining methods, to shorten the length of the first branch 102. A set screw 106 may be provided through a sidewall of the first branch 102 to help support the scoring ball 20 within the first aperture 22*b*. While a set screw 106 is shown and described herein to facilitate supporting the scoring ball 20 in the first aperture 22*b,* it will be appreciated that various other structure suitable to facilitate supporting scoring ball 20 may alternatively be used.

The second branch 104 of the double-cross fitting 100 defines the second aperture 52*b* through which the scoring ball 20 supported in the first aperture 22*b* may be viewed by a player 34, as described above. In this embodiment, the first receptacle 48*b* may be coupled proximate the second aperture 52*b* by a fastener 108 secured through a sidewall of the second branch 104 of the double-cross fitting 100. Various other features and functions of the apparatus 10*b* may be similar to those described above with respect to apparatus 10 of FIGS. 1-4C or apparatus 10*a* of FIGS. 5 and 5A.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. An apparatus for playing a skill game, the apparatus comprising:

a generally vertically extending tube having a first lower end, a second upper end, and an axially extending passage;

at least one outlet proximate said first end of said tube;

a scoring ball;

a portion of said tube configured and arranged to support said scoring ball thereon such that said scoring ball is able to fall through said axially extending passage;

a play ball supported by a flexible tether for swinging movement in a direction toward said portion of said tube configured to support said scoring ball; and a first receptacle spaced from said portion of said tube configured to support said scoring ball, said first receptacle positioned to receive said scoring ball when appropriately struck by said play ball; whereby when said scoring ball is struck by said play ball, said scoring ball is displaced to either fall into said first receptacle, or to fall through said axially extending passage of said tube toward said at least one outlet.

2. The apparatus of claim 1, further comprising a ball mount intermediate said first and second ends of said tube for supporting said scoring ball thereon.

3. The apparatus of claim 1, wherein said tether is operatively coupled proximate said second end of said tube, said tether sized and arranged to permit a user to swing said play ball in a direction toward said scoring ball in an attempt to strike said scoring ball and knock said scoring ball into said first receptacle.

4. The apparatus of claim 3, further comprising:

a boom operatively coupled proximate said second end of said tube;

said boom having a distal end extending outwardly from said tube and supporting said play ball on said tether to thereby space said play ball from said tube.

5. The apparatus of claim 1, wherein said at least one outlet comprises first and second outlets proximate said first end of said tube.

6. The apparatus of claim 5, further comprising second and third receptacles positioned proximate said first and second outlets, respectively, for receiving said scoring ball when said scoring ball falls through said axially extending passage of said tube after being struck by said play ball.

7. The apparatus of claim 6, wherein said second receptacle represents a sand hazard, and said third receptacle represents a water hazard.

8. The apparatus of claim 1, further comprising:

first and second apertures formed though a sidewall of said tube such that said first aperture is disposed opposite said second aperture;

said scoring ball supported proximate said first aperture, and said first receptacle positioned proximate said second aperture, such that said scoring ball must pass across said axially extending passage of said tube, from said first aperture to said second aperture, to be received in said first receptacle.

9. The apparatus of claim 1, further comprising:

at least one marker adjustably movable relative to said tube for identifying a location from which a user is to swing said play ball in a direction toward said scoring ball in an attempt to strike said scoring ball.

10. A method of playing a skill game, the method comprising:

supporting a scoring ball on a generally vertically extending tube such that the scoring ball is able to fall through an axially extending passage of the tube; and directing a play ball supported on a tether in a direction toward the scoring ball in an attempt to strike the scoring ball and thereby knock the scoring ball into a first receptacle.

11. The method of claim 10, further comprising:

determining a score after attempting to strike the scoring ball with the play ball based on whether the play ball missed the scoring ball or the scoring ball was knocked into the first receptacle.

12. The method of claim 11, wherein determining a score is further based on whether the scoring ball was caused to be received into at least one receptacle other than the first receptacle.

* * * * *